United States Patent [19]

Warren et al.

[11] 4,074,789

[45] Feb. 21, 1978

[54] MOBILE ROLLING SUPPORT SYSTEM FOR SCAFFOLDING USED IN BUILDING CONSTRUCTION

[75] Inventors: Daniel E. Warren, Centerville; Donald M. Taylor, Hamilton, both of Ohio

[73] Assignee: Armco Steel Corporation, Middletown, Ohio

[21] Appl. No.: 657,980

[22] Filed: Feb. 13, 1976

[51] Int. Cl.[2] ..... E04G 3/10; E04G 3/14

[52] U.S. Cl. ..... 182/37; 182/14; 182/142

[58] Field of Search ..... 182/36, 37, 14, 142, 182/45; 248/429, 430, 237, 235

[56] References Cited

U.S. PATENT DOCUMENTS

| | | | |
|---|---|---|---|
| 2,639,950 | 5/1953 | Wheeler | 182/37 |
| 3,302,750 | 2/1967 | Arnold | 182/37 |
| 3,854,550 | 12/1974 | Shingler | 182/36 |

*Primary Examiner*—Reinaldo P. Machado

*Attorney, Agent, or Firm*—Melville, Strasser, Foster & Hoffman

[57] ABSTRACT

A rolling support for moving scaffolding alongside the side or end of a building under construction, the support including frame structure which rigidly connects two outriggers together, a leading outrigger and a trailing outrigger, each of such outriggers having a near-side traveling wheel to ride on an exposed structural roof member adjacent the side or end of a building, and a far side force roller which extends beneath a parallel exposed structural roof member inwardly from the side or end of the building, the outriggers being parallel to one another and riding on parallel exposed structural roof members. The near-side travel wheel bears down on its exposed roof member and exerts substantial downward pressure thereon while the far-side force roller bears upwardly against the underside of its exposed roof member. Remote controlled motor means are mounted on the frame so as to drive the near-side traveling wheel. Additional frame structure extends from the outriggers beyond the side or end of the building and scaffold structure is attached thereto.

17 Claims, 12 Drawing Figures

MOBILE ROLLING SUPPORT SYSTEM FOR SCAFFOLDING USED IN BUILDING CONSTRUCTION

BACKGROUND OF THE INVENTION

1. Field of the Invention

This rolling scaffold support device has particular application in the erection of buildings, primarily the placing of side wall panels and end wall panels, wherein structural roof members such as I-beams, T-channels, C-purlins and/or Z-purlins are normally used to support the building roof. These purlins or other such members support the rolling scaffold support device and the device will be positively fastened thereto for safety, but in such manner that the device may be moved along the purlins as panel placement proceeds. The device may be placed on the purlins at one end of the building and moved to the other end in increments as desired without the workers having to climb the building each time it is necessary to move the scaffold along the side thereof. When one side is completed the scaffold may be moved to the other side. Temporary purlins, or other temporary structural roof members, may be laid across the permanent ones in order to do the end walls. The roof is finally placed after the rolling scaffold support device is removed. It is to be emphasized that the rolling support of this invention is particularly adapted for use in the actual construction of buildings as distinguished from use in, on or with buildings all ready completely erected.

2. Description of the Prior Art

Prior devices for supporting scaffolds utilized fixed supports anchored to side wall columns or other structural members, requiring dismantling of same to move the scaffolds to required new positions. This is the time consuming and inefficient. Floor supported scaffolds have been used on some buildings wherein relatively low side walls are involved.

A search of the United States Patent Office was conducted in an effort to find those prior United States patents most pertinent to the subject matter of this invention. No assertion is made, however, that the most pertinent United States patents were in fact located by this search although that was indeed the intent and purpose thereof. Those patents developed by the search are Nos.: 523,978-Dunning, 862,622-Eller, 884,813-Gordnier, 1,470,388-Pitou, 1,642,333-Damore, 1,699,544-Rohlfing, 2,396,127-Riblet, 2,532,661-Combs, 2,645,531-Rector, 2,761,396-Harlan, 2,639,950-Wheeler, 2,930,441-Lacy, et al., 3,394,776-Abrams, 3,491,851-Dutcher, 3,543,687-Ellzey, 3,643,761-Melton, 3,702,124-Highland, 3,814,211-Pamer, 3,825,098-Shingler, 3,854,550-Shingler and, 3,900,080-Rea and 3,391,757-Duke.

U.S. Pat. No. 3,854,550 purports to relate to a mobile outrigger for scaffolds. The mobile out-riggers of this patent travel on planking rather than purlins and labor must be used to lay the planking before and to remove it afterwards. The device of the patent uses counter-weights to off set the weight of the scaffold in contrast to the positive force rollers used in the rolling support of the instant invention. The use of counter-weights adds extra weight to the roof and is not so positive a safety restraint as are the force rollers. The patented structure does not use the cross bracing employed in the rolling support of the instant invention and it would appear that the outriggers of the patent could easily leave the planking on which they are mounted thus causing possible injury to workers and damage to materials.

Dunning U.S. Pat. No. 523,978 discloses a fire escape designed to be moved on rails fixed around the side of a building. A truck, composed of a yoke c, from which the fire escape mechanism depends, is provided with upper and lower flanged wheels *c'* which embrace the upper and lower edges of the guide rail *b'*. Eller 862,622 shows a store ladder suspended from a carriage 6 having a pair of upper wheels 7 which ride on the upper flange of a fixed rail 3 and a single lower wheel 8 that is adapted to ride against the lower flange of the rail.

Damore No. 1,642,333 shows a carriage utilizing a pair of double flanged wheels riding on a track, the carriage supporting a painter's scaffold. Rohlfing No. 1,699,544 (FIG. 6) is another disclosure of a flanged carriage wheel riding on a rail.

Riblet No. 2,396,127 is of interest in its showing of an arrangement for pivoting one of the wheels 63, which normally rides on the lower flange of an I-beam, out of the way.

Harlan No. 2,761,396 is of interest in its arrangement for providing wheels carried by arms which are mounted for outward rocking movement to permit one pair of wheels to be moved outwardly to clear an intersecting beam as the carriage is moved along, see column 1, lines 15 through 45.

Wheeler No. 2,639,950, see especially FIGS. 4, 7 and 9, is of interest in its showing of a relatively narrow wheel 11 engaged between members 39 defining a narrow channel on a rail 38.

Duke, et al. U.S. Pat. No. 3,391,757 (FIGS. 1, 3 and 5) is of interest in that it shows vertical rollers 14 cooperating with horizontal rollers 17 riding on and engaging an eave beam, the arrangement also including a guard 23 which is said to lock the carriage on the beam and prevent its accidental removal, the guard 23 extending beneath the eave member which is engaged by the rollers 14 and 17.

Dutcher U.S. Pat. No. 3,491,851 is also pertinent in its disclosure not only of supporting wheels 14 but also in its disclosure of what are termed "thrust wheels" 31 and 40.

Rea U.S. Pat. No. 3,900,080 (FIG. 5) shows a lower flanged wheel 66 riding on a bottom track and an apex flanged wheel 82 which may engage an upper track; cantilever beam structure 54 is provided for stability.

SUMMARY OF THE INVENTION

The rolling scaffold support device is adapted to ride on structural roof members such as I-beams, T-channels, C-purlins and/or Z-shaped roof purlins before the roofing is installed. The device may be assembled in the shop and, at the job site, it may be lifted by crane, fork lift and the like to one end of the roof. The device supports the scaffold from which the building panels are installed. As the panels are installed, the device is moved from one end of the building to the other end, traveling on the purlins or comparable structural roof members. The device may be controlled from the ground and it is necessary for men to go to the roof each time it is desired to move the device along the purlins. After the first side is completed, the support device is disconnected from the structural roof members and taken to the opposite side of the building and the process repeated.

The rolling scaffold support device may also be used to do the front and back ends of the building simply by placing temporary purlins or other temporary structural roof members in place at right angles to those used eventually actually to support the roof.

Conventional scaffolding systems heretofore employed were normally fixed to the building structural members. After each section of building panels was installed, men had to climb onto the roof to disconnect and move the structure to the next section. This kind of safety hazard and down time is eliminated with the instant development.

After the apparatus, comprised of the two outriggers, leading and trailing, joined by the frame members and including the various travel wheels and force rollers which ride on and under the structural roof members, is placed on such members, the force rollers will engage the underside of the particular structural roof members employed, especially those force rollers at the far-side of the apparatus, and prevent rotation or uplifting of the apparatus from such members.

Preferably the leading outrigger includes a frame member on which are mounted the leading near-side and far-side travel wheels, driven and idler, and the trailing outrigger includes another frame member on which are mounted the trailing near-side and far-side idler travel wheels. The scaffold is connected by cable to the outboard ends (those projecting beyond the eave of the building under construction) of each of these last mentioned frame members. And these last mentioned frame members are those which are connected by the cross members earlier mentioned.

BRIEF DESCRIPTION OF THE DRAWINGS

FIG. 6 is a fragmentary section similar to that of FIG. 5 but showing the near-side portion of the trailing outrigger.

DESCRIPTION OF THE PREFERRED EMBODIMENTS

The mobile rolling support system for scaffolding used in building construction comprises a rolling support made up of two outriggers joined together by suitable brace members and having a plurality of travel wheels and force rollers mounted thereon for engagement with various of the structural roof members. The various wheels and rollers on the side of the building nearest the scaffold will be referred to as being on the near-side while the various wheels and rollers at the opposite side away from the scaffold will be referred to as being on the far-side. The structure is a cantilever arrangement having a downward force on the near-side and an upward force on the far-side. The leading outrigger is generally indicated at 39 in FIGS. 1, 3, 5 and 7 and the trailing outrigger is generally indicated at 40 in FIG. 6. Each of these outriggers has two near-side traveling wheels with each such traveling wheel having a companion force roller below.

Figures 3, 4:
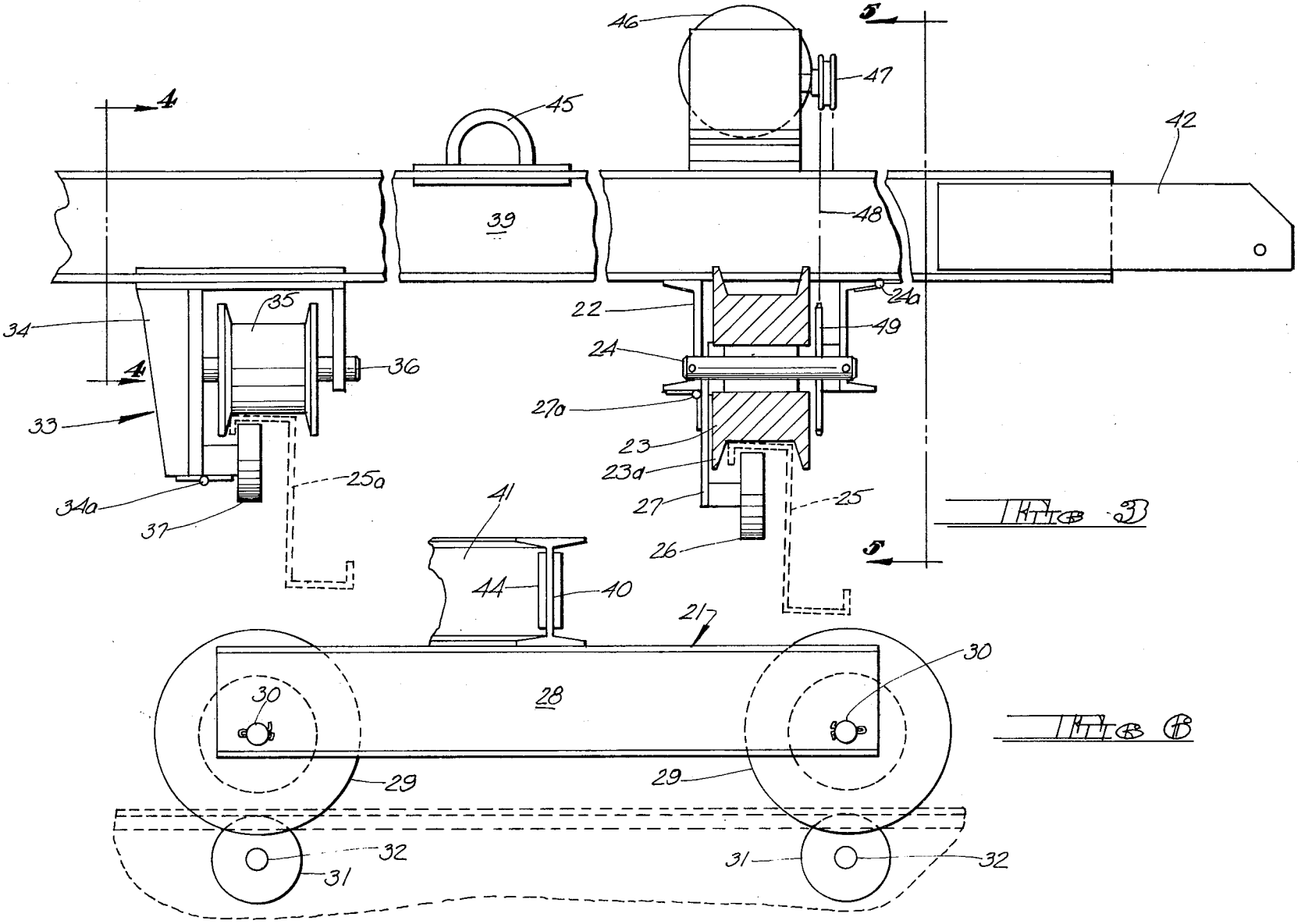
FIG. 3 is a fragmentary front end elevation, partly in section, and enlarged, of the rolling scaffold support device shown in FIG. 1.
FIG. 4 is a section taken along the line 4—4 of FIG. 3 and showing the far-side portion of the leading outrigger.
Figure 4A:
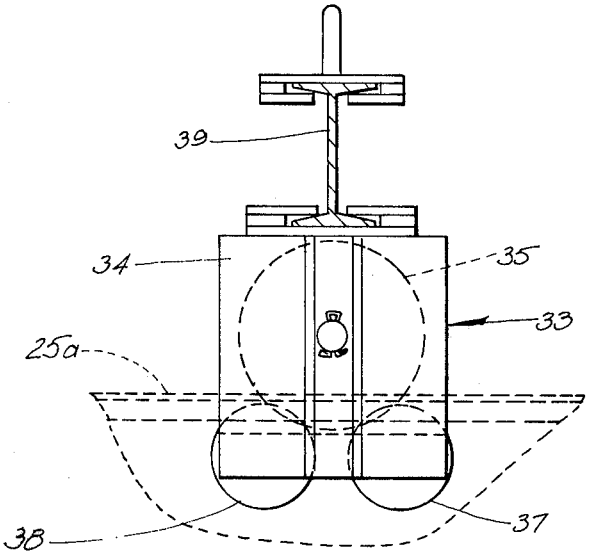
Figure 5:
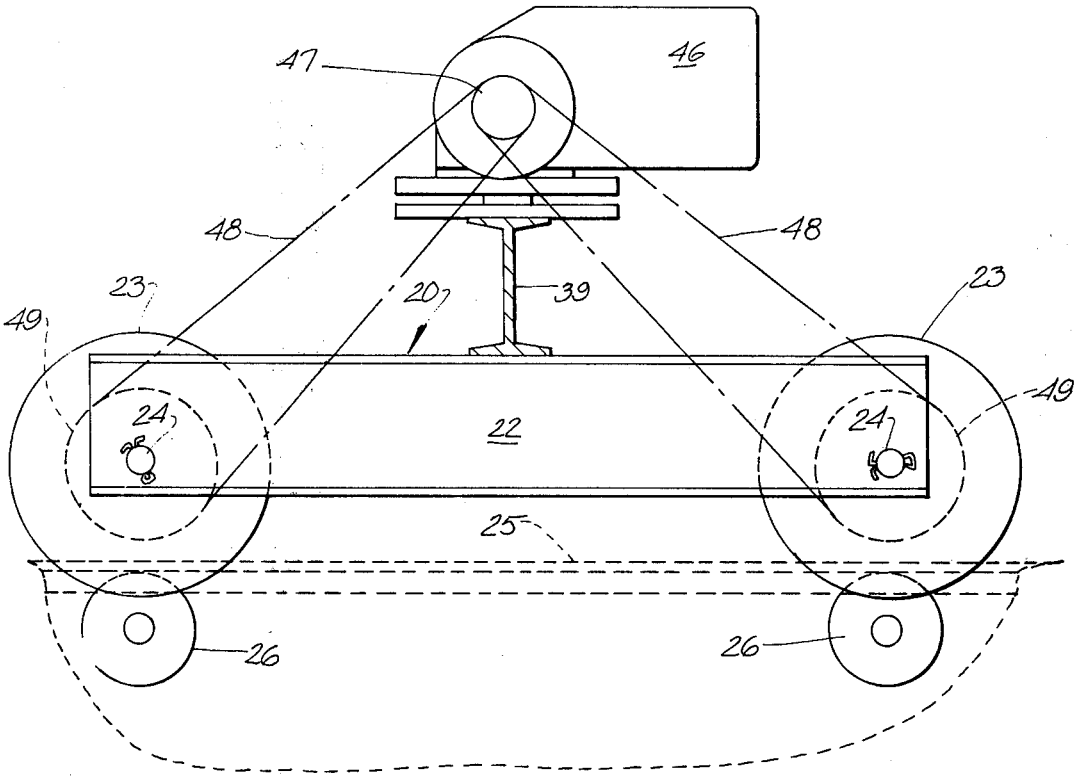
FIG. 5 is a section taken along the line 5—5 of FIG. 3 and showing the near-side portion of the leading outrigger.

The leading outrigger 39 shown in FIG. 5 includes a frame member which may be comprised of frame structure 20 and an I-beam 22 on which are suitably, rotatably mounted near-side traveling wheels 23, the axels for the wheels being indicated at 24. As seen in FIG. 3 the wheels 23 are flanged as indicated at **23*a* and are designed to ride on the upper portion of, in this instance, a Z-purlin 25. Each of the traveling wheels 23 may have a companion force roller 26 rotatably mounted on structure 27 (see FIG. 3) depending from the I-beam 22. The force roller 26 extends beneath that portion of the Z-purlin 25 on which the wheels 23 ride. Hinge means 27*a* may be provided to aid in the positioning of the rolling support on the structural roof member 25. Hinge means 24*a* may also be provided for the travel wheels 23**.

The trailing outrigger 40 of FIG. 6 is generally similar to that of FIG. 5 and includes frame structure 21 which may be comprised of the I-beam 28 having near side traveling wheels 29 journaled thereon as indicated at 30, each of the traveling wheels 29 having a companion force roller 31 suitably journaled at 32 on frame structure depending from the I-beam 28. The flanged traveling wheels 29 also ride on the upper portion of the Z-purlin 25 and the companion force rollers 31 extend below such portion. The near-side force rollers 26 and 31 may not be absolutely necessary, because most of the near-side forces are downwardly on the upper portion of the structural roof member 25, but they are preferred as an added safety measure to keep the rolling support in proper position under all conditions.

Figure 1:
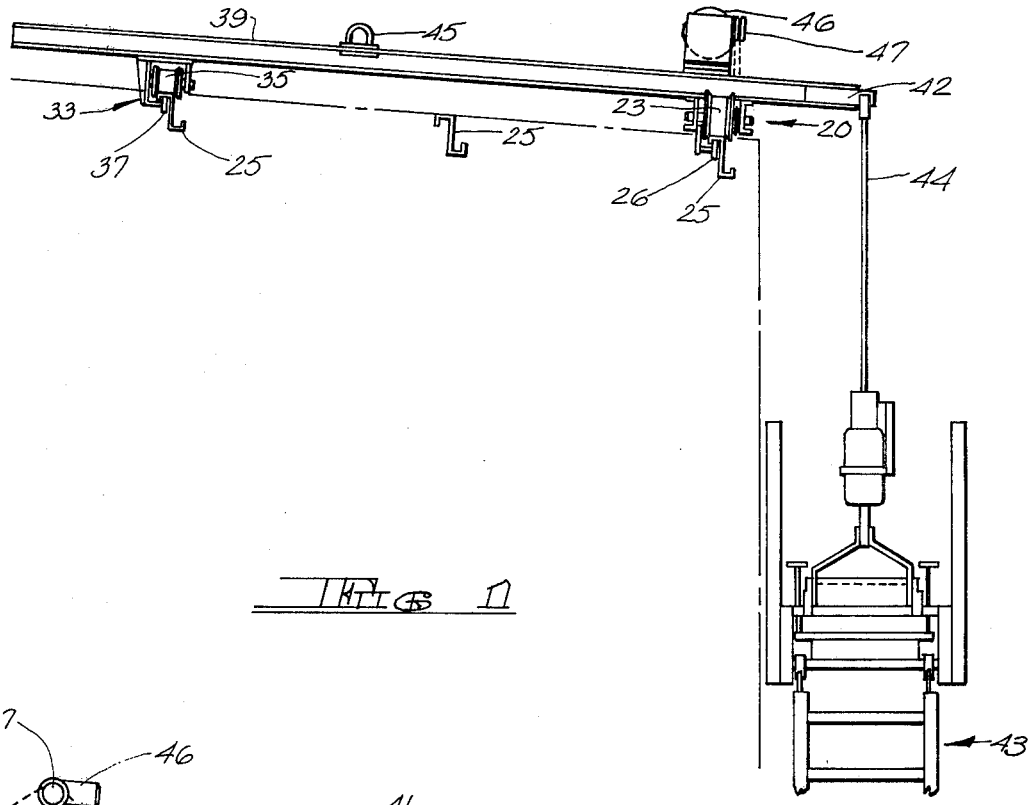
FIG. 1 is a front end view of the rolling scaffold support device and scaffold structure showing the support device mounted on the Z-shaped purlins and the scaffold seen at the side of the building.

The leading outrigger 39 also includes far-side frame structure generally indicated at 33, see FIGS. 1, 3 and 4; there is also a similar far-side frame member (not shown) on the trailing outrigger 40. It is pointed out that the leading and trailing, far-side frame structures 33 may be identical and a description of one, therefore, will serve as a description of both.

As shown in FIGS. 3 and 4 the leading (and trailing), far-side frame structures 33 are comprised of a frame member having a single traveling wheel 35 journaled thereon as indicated at 36. The flanged traveling wheel 35 will ride, in this instance, on a Z-prulin 25*a* which is parallel to the purlin 25. A pair of companion force rollers 37 and 38 are also journaled on the frame structure 34 and these force rollers extend beneath that portion of the Z-purlin 25*a* on which the flanged traveling wheel 35 rides.

The two traveling wheels 23 journaled at the ends of the near-side I-beam 22 and the two traveling wheels 29 journaled at the ends of the near-side I-beam 28 (total of four traveling wheels on the near-side) support the weight of the scaffold. In contrast, there is only one traveling wheel 35 for each of the frame structures 33 on the far-side. Each of these two far-side traveling wheels 35, however, has the two companion force rollers 37 and 38 which must support the uplift force. The traveling wheels 23 and 29 may, in some instances, be of greater diameter than the traveling wheels 35 in order to compensate to some extent for the downward slope of the roof towards the eave (near-side). The relatively large size of the traveling wheels 23 and 29 makes for greater ease of movement of the rolling support on the structural roof members. To the extent that the smaller sized traveling wheels 35 makes it possible to shorten the frame structure 34, so also is it possible to make this structure 34 of greater strength. This is important because the force rollers 37 and 38 which are journaled in this structure 34 must sustain substantially all of the uplift forces applied to the rolling support. It will be understood, therefore, that the hinge means 34*a*, which may be used when positioning the rolling support on the structural roof members, should be of heavy-duty construction. In practice, however, it is possible to make all of the traveling wheels 23, 29 and 35 of one diameter, and all of the force rollers 26, 31, 37 and 38 of another diameter.

The basic frame structure is completed by a pair of cross members 41 which join the leading and trailing outriggers 39 and 40 respectively. The outboard ends (eave, near-side) of the frame members (outriggers) 39 and 40 extend beyond the frame members 22 and 28 respectively and are provided with means 42 from which the scaffold structure generally indicated at 43 depends as indicated at 44. Lift hook means 45 may be secured to the frame members (outriggers) 39 and 40 so that the rolling support may be gotten to and from the building roof by a suitable crane and the like.

Figure 2:
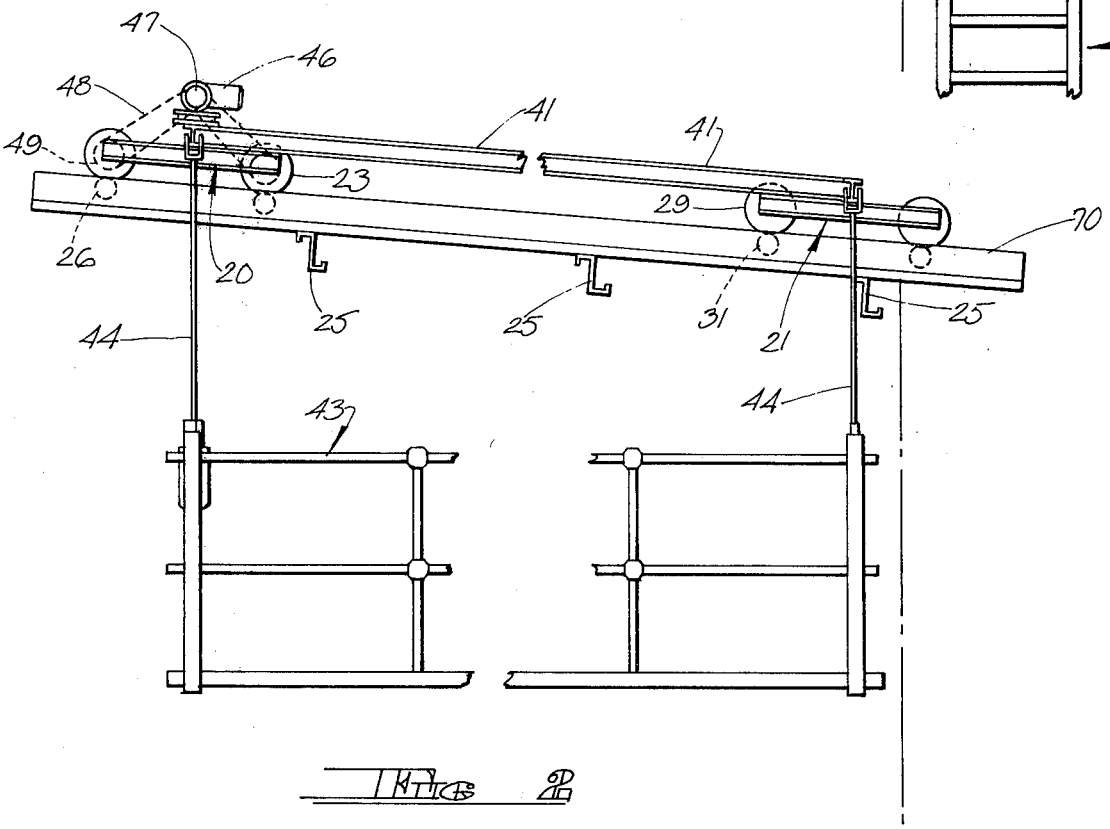
FIG. 2 is a somewhat schematic side elevation of the rolling scaffold support device in place on temporary purlins laid across the standard purlins, the scaffold being on the front end of the building.

As seen in FIGS. 2 and 5 the rolling support is powered by means of a motor 46 mounted on the frame member (outrigger) 39 and driving a pulley arrangement 47 which in turn drives a pair of chains 48 suitably connected to sprockets 49 fastened to the traveling wheels 23 on the near-side of the leading outrigger 39. In the preferred arrangement only this pair of traveling wheels 23 is driven; it is not necessary to drive the traveling wheels 29 on the near-side of the trailing outrigger 40 nor is it necessary to drive either of the traveling wheels 35 on the far-side of the two outriggers. As a matter of fact it is entirely possible that, when the rolling support is fully positioned on the structural roof members and the scaffold structure 43 is hooked up thereto, the wheels 35 may not even engage the structural roof members beneath them. The various force components will be transmitted through the far-side force rollers 37, 38 and the near-side traveling wheels 23, 29.

As seen in FIG. 1 the rolling support of this invention is mounted to ride on roof purlins 25 or other structural roof members employed, which extend from one end of the building to the other. The scaffold structure 43 is supported at 44 from the outboard ends of the frame members 39 and 40 as indicated at 42 and 44. The scaffold structure will be moved along the side of the building as the panels are put in place.

When it is desired to place a panel on the front and rear ends of the building, temporary purlins 70, or other suitable structural roof members, see FIG. 2, may be placed on and at right angles to the roof purlins 25 and the rolling scaffold support device may then travel on these temporary purlins 70 in the same menner as described in connection with the regular roof purlins 25. The near-side traveling wheels 23 an 29 will ride on a temporary purlins 70 while the companion force rollers 26 and 31 will extend therebeneath; in similar manner the far-side traveling wheels 35 will also ride on a companion parallel temporary purlin 70 and the companion force rollers 37 and 38 will extend therebeneath.

In practice the various beam members such as those indicated at 39, 40 and 41, along with the members 22, 28 and 34, may be made of structural aluminum and the travel wheels 23, 29 and 35 may be cast and machined aluminum. Wear sections, clamps, motor mounts and following force rollers may be fabricated from high-strength steel plates. Lateral movement of the rolling support is accomplished by means of the double chain drive and motor 48, 46 at a rate not to exceed 20 FPM. The electricl motor 46 may be supplied by any convenient 110 V outlet or portable generator. Hand cranking may also be used if an electrical source is unavailable. A dead man switch and an automatic motor brake are included. It will be apparent that an additional safety feature stems from the fact that all movement may be controlled at ground level.

From the foregoing it will be apparent that the various force rollers 26, 31, 37 and 38 provide a positive restraint holding the rolling scaffold support device to the roof. The need for counter-weights is eliminated. A man is not required to climb to the roof each time the rolling support must be removed, thus there is much less down time as compared to prior arrangements. The mobile rolling support for scaffolding used in building construction, remotely controlled from the ground is safer than one that must be manually moved from the top of the building. As indicated, the structures employed in constructing the rolling support are light, easy to manufacture, inexpensive, and easily lifted by crane or forklift to the roof and quickly installed.

The modifications required for the outrigger and scaffold system to be used on building ends as shown in FIG. 2, as distinguished from the sides as shown in FIG. 1, require only temporary changes in the roof structure, not in the rolling support itself. The Z-purlins, or other structural roof members, that support the rolling support are parallel to the sides of the building, running from one end to the other. In order for the rolling support to move at right angles to this direction, temporary Z-purlins 70, or other track devices, would temporarily be laid on top and perpendicular to the permanent purlins 25. Only two rows of such temporary purlins, however, are required and these are removed immediately after installation of the end wall panels.

Figures 7, 8:
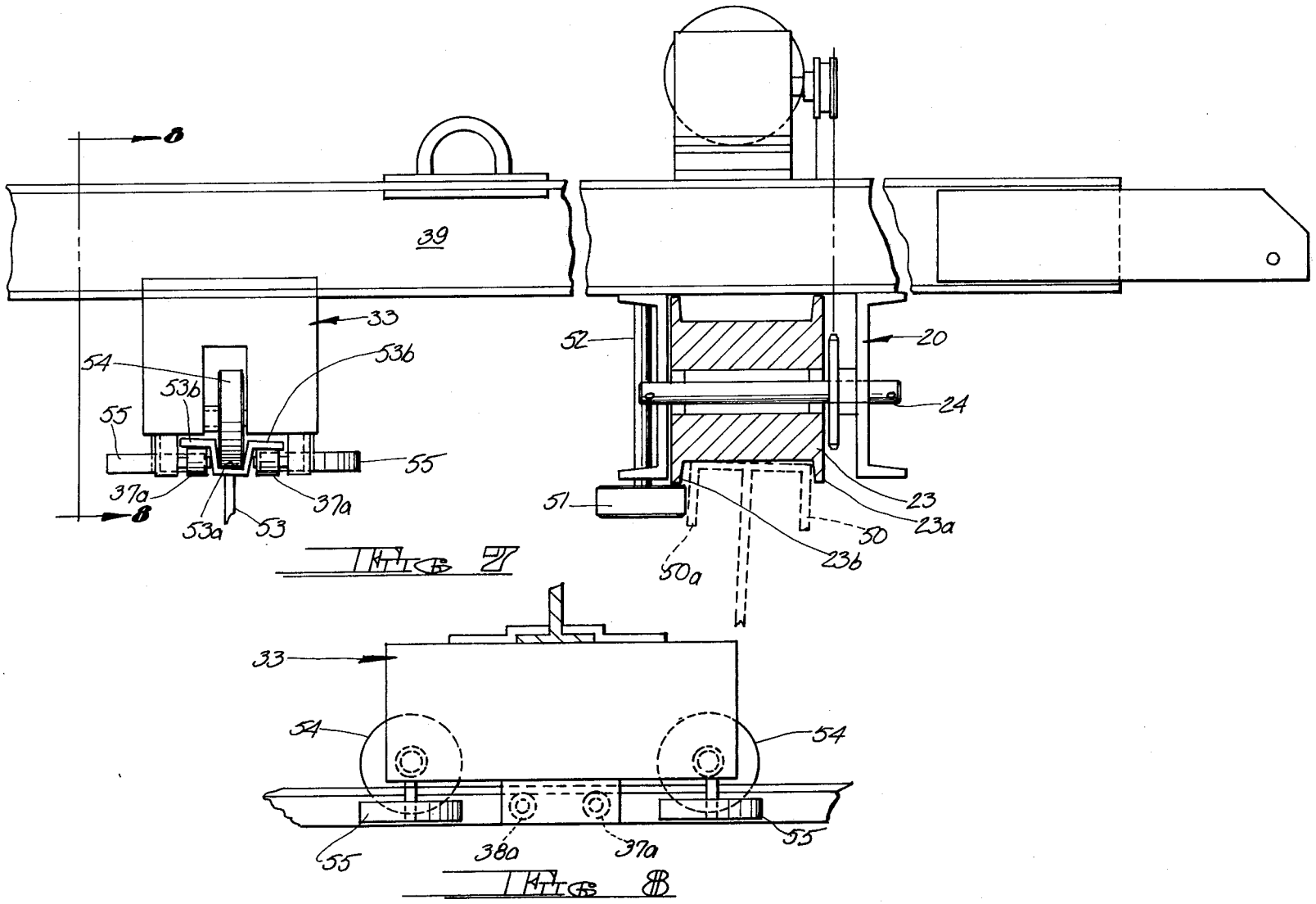
FIG. 7 is a fragmentary front end elevation, partly in section, generally similar to FIG. 3, showing a modification of the rolling support generally depicted in FIG. 1, and also illustrating use of a fairly standard bar joist as an interior structural roof member on which the rolling support is mounted.
FIG. 8 is a section taken on the line 8—8 of FIG. 7.

Modifications may be made in this invention. Some of these have been illustrated in FIGS. 7 through 12. In FIG. 7 the rolling support including the leading outrigger 39 is depicted as it may be used in conjunction with a roof structure which employs a T-channel at the eave side of the building and a plurality of like winged-shaped, U-bar joists arranged parallel thereto. The near-side traveling wheel 23 is like that shown in FIG. 3 and the flanges 23*a* thereof will be disposed at either side of the T-channel 50. One or more force rollers 26 (not shown in FIG. 7) may be employed and disposed beneath the underside of the T-channel 50.

In the arrangement of FIG. 7 a thrust wheel 51 is journalled on a suitable vertical axle which is a part of the frame structure 20 fixed to the outrigger 39. Preferably the horizontal thrust wheel 51 and axle 52 are positioned so that the wheel 51 will engage the side 50*a* of the T-channel in such manner as to prevent the flange 23*b* from engaging the side 50*a*. This arrangement prevents the flange 23*b* from gouging the side 50*a* of the T-channel 50 and insures easy rolling movement of the traveling wheel 23 on the T-channel 50. The horizontal thrust wheel 51 also serves as an added safety device to prevent the rolling support from sliding off the structural roof members.

In the arrangement shown in FIG. 7 it is necessary for the vertical axle 52 to be off set with respect to the axle 24 in order that the flange 23*b* and horizontal thrust wheel 51 may both be accommodated. It would be possible, however, to eliminate the flange 23*b* of the traveling wheel 23 and to locate the vertical axle 52 directly opposite the end of the axle 24 thus making for a more simple construction. The thrust wheel 51, while no longer having to keep the flange 23*b* out of contact with the side 50*a* of the T-channel 50, would still have its safety function as above described.

The leading, far-side frame structure 33 fixed to the outrigger 39 is depicted in FIG. 7 as arranged to be supported from a fairly standard bar joist 53. Such joist, in this instance, is depicted as having a central, U-shaped trough 53*a* and a pair of horizontal projections 53*b*. In this arrangement the flanged, far-side traveling wheel 35 of FIG. 3 has been replaced by the relatively narrow traveling wheel 54 which is adapted to be received within the trough 53*a*. This traveling wheel 54 is suitably journaled in the frame structure 33. A plurality of force rollers 37*a l and 38a,* also suitably journaled in the frame structure 33, are positioned so as to engage the underside of the horizontal projections 53*b* of the bar joist 53. The U-shaped trough 53*a* could be rounded or, as will be discussed in connection with FIG. 11, the trough may be eliminated in its entirety.

As best seen in FIGS. 7 and 8 there is a pair of force rollers 37*a* disposed opposite one another on either side of the trough 53*a*, and a pair of force rollers 38*a* spaced from the first pair and also disposed on either side of the trough 53*a*. In the arrangement of these figures a pair of travel wheels 54 is employed. The force rollers 37*a* and 38*a* are located between the travel wheels 54. The four force rollers 37*a*, 38*a*, acting on the underside of the horizontal projections 53*b*, sustain substantially all of the uplift forces exerted on the rolling support when it is located on the structural roof members 50 and 53, and the scaffold structure attached to the rolling support. Under these operating conditions it is possible that the traveling wheels 54 will bear very lightly against, if at all, the bottom of the trough 53*a* of the bar joist 53.

A further safety feature is also illustrated in these FIGS. 7 and 8. A plurality of thrust wheels 55, horizontally disposed, are suitably journaled in the frame structure 33. These wheels 55 will project inwardly beneath the flanges 53*b* and towards the outer sides of the trough 53; these wheels 55, however, will be spaced from the horizontal projections 53*b* and preferably will stop short of the outer sides of the trough 53. In case of an emergency, they will limit lateral slipping movement of the rolling support with respect to the structural roof members, at which times the wheels 55 would come into contact with the sides of the trough 53*a* of the bar joist 53, and they also serve to prevent the lifting off of the rolling support from the structural roof members 53 should for any reason the rollers 37*a*, 38*a* fail to function properly.

Figure 9:
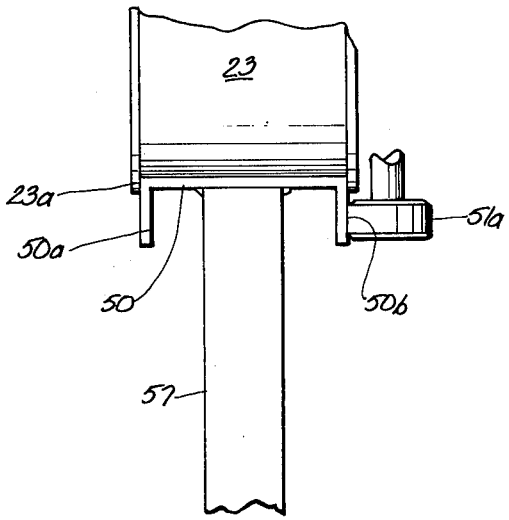
FIG. 9 is a fragmentary, partly schematic view depicting the arrangement of a near-side travel wheel in conjunction with a thrust wheel, all as associated with a T-channel.

Further variations of the invention are somewhat schematically depicted in FIGS. 9 through 12. FIG. 9 again depicts a flanged traveling wheel 23 disposed on a T-channel 50. In view of the fact that this T-channel 50 is located at the eave, near-side of the roof, uplift resisting, force rollers have been eliminated. In the arrangement of FIG. 9 a horizontal thrust wheel 51*a* is depicted on the eave side 50*b* of the T-channel 50. It would also be possible to locate a horizontal thrust wheel 51 (as shown in FIG. 7) so as to engage that side 50*a* of the T-channel 50 which is removed from the eave; it would also be possible, of course, to employ both of the horizontal thrust wheels 51 and 51*a*.

Figure 10:
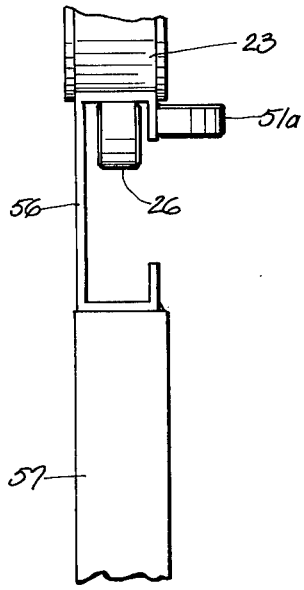
FIG. 10 is a fragmentary, partly schematic view depicting the arrangement of a travel wheel, thrust wheel and force roller as they might be utilized in conjunction with a C-purlin.

In FIG. 10 the rolling support is illustrated in conjunction with a structural roof member comprising a C-purlin 56. The flanged wheel 23 engages over the top of this C-purlin and one or more force rollers 26 may be disposed beneath the top of such purlin. One or more thrust wheels 51*a* may be disposed opposite the upper leg of the "C".

In all of the arrangements depicted in FIGS. 9 through 12 the various structural roof members are illustrated as being located on columns 57.

Figure 11:
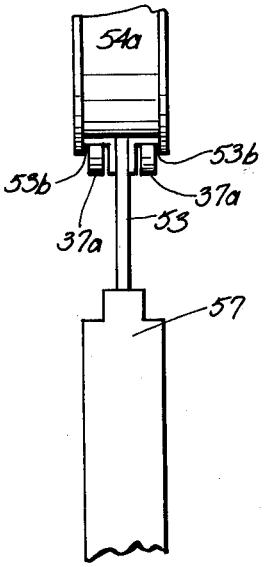
FIG. 11 is a fragmentary, partly schematic view depicting a travel wheel and force roller as they could be utilized in connection with an interior structural roof member (bar joist) somewhat modified as compared to that depicted in FIG. 7.

The arrangement of FIG. 11 is a variation of that shown at the left of FIG. 7. In such variation the trough 53*a* of the bar joist 53 has been eliminated and, therefore, the relatively narrow traveling wheel 54 has been replaced by the relatively wide, flanged travel wheel 54*a* (like 35) which extends across and embraces the members 53*b*. The force rollers 37*a* will be retained. If desired, thrust wheels 51, 51*a* could also be employed and disposed at one or the other, or both, of the sides of the bar joist 53 but spaced from the force rollers 37*a*.

Figure 12:
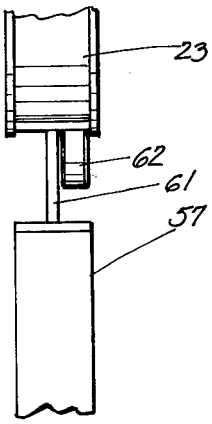
FIG. 12 is a fragmentary, partly schematic view depicting a travel wheel and force roller as they could be used in conjunction with an I-beam.

FIG. 12 depicts an I-beam 61 mounted on a column 57. A flanged travel wheel 23 is shown as engaged over the top of the "I" and a force roller 62 is depicted as disposed beneath the underside of such top member.

To the extent that it is possible and/or feasible to employ the various structural roof members depicted in FIGS. 9 though 12, namely, the T-channel 50, the C-purlin 56, and the I-beam 61, in place of the interior bar joist such as the winged member 53 of FIG. 7, or the variation thereof of FIG. 11, so also could the various traveling wheels and force rollers, and horizontal thrust wheels as well, for the farside of the leading and trailing outriggers 39 and 40, be employed. In this connection it is to be understood that the hinged arrangements generally depicted at 24*a*, 27*a* and 34*a* of FIG. 3 could also be employed with all of the traveling wheels, near-side and far-side, and force rollers, and thrust wheels, in order not only to permit the rolling support to be easily assembled on the structural roof members, but also so as to permit web brace structure and columns to be by-passed as the rolling support moves on the various structural roof members, as will be well understood by those skilled in the building art.

It will be apparent to those skilled in the art that still other modifications may be made in this invention without departing from the scope and spirit thereof. It is also to be understood that while the invention has been shown and described in terms of particular structures and arrangements, the invention is not to be considered as limited only to these structures and arrangements except insofar as they are specifically set forth in the subjoined claims.

Having thus described the invention, what is claimed as new and what is desired to be protected by Letters Patent is:

1. A mobile rolling support system for scaffolding used in building construction prior to installation of roof panels, including a rolling support comprising: frame structure rigidly connecting two outriggers together, one being the leading outrigger and the other being a trailing outrigger, each outrigger having at least one near-side traveling wheel to ride on an exposed structural roof member adjacent the side (or end) of a building and at least one far-side force roller extending beneath a parallel exposed structural roof member removed from said building side (or end), said outriggers being parallel to one another and adapted to extend across and ride on said parallel exposed structural roof members; said near-side traveling wheels bearing down on their exposed structural roof member and exerting substantial downward pressure thereon and the said far-side force rollers bearing against the underside of said parallel exposed structural roof member to exert substantial uplift pressure thereagainst; remote controlled motor means on said frame structure to drive a said at least one near-side traveling wheel; and support means extending from said rolling support and to which support means scaffold structure may be attached; whereby said motor means may be actuated from time to time to move said rolling support along said exposed structural roof members so that the scaffolding structure is moved along the side (or end) of said building.

2. The device of claim 1 in which each of said outriggers has a pair of said far-side force rollers bearing against the underside of said parallel exposed structural roof member.

3. The device of claim 2 in which each of said outriggers has a far-side traveling wheel disposed above one of said pairs of far-side force rollers for engagement with said parallel exposed structural roof member.

4. The device of claim 1 in which each of said outriggers has a pair of said near-side traveling wheels thereon.

5. The device of claim 4 including four additional force rollers, one for each of said near-side traveling wheels, said additional force rollers being adapted to extend beneath said exposed structural roof member adjacent the side (or end) of a building.

6. The device of claim 4 in which said motor means is drivingly connected to a pair of the said near-side traveling wheels which are mounted on the same outrigger.

7. The device of claim 6 in which the said pair of traveling wheels that is drivingly connected to said motor means is located at the forward end of the path along which the device is to be moved.

8. The device of claim 1 in which said frame structure includes a first frame member extending at right angles to said exposed structural roof members and comprising a part of one of said outriggers and a second frame member extending parallel to said first frame member and comprising a part of the other of said outriggers, and a pair of cross frame members extending between said first and second frame members.

9. The device of claim 8 in which there is a said support means on each of said first and second frame members.

10. The rollong suppor of claim 1 including a horizontal thrust wheel operatively connected to each of said outriggers and extending towards the side of one of said exposed structural roof members.

11. A rolling support for use with exposed structural roof members, said rolling support comprising: a leading outrigger, a near-side traveling sheel journaled in said leading outrigger and adapted to ride on a first exposed structural roof member, a far-side force roller journaled in said leading outrigger and adapted to engage beneath a second exposed structural roof member; a trailing outrigger, a near-side traveling wheel journaled in said trailing outrigger and adapted to ride on said first exposed structural roof member, a far-side force roller journaled in said trailing outrigger and adapted to engage beneath said second exposed structural roof member; frame means connecting said leading and said trailing outriggers; motor means on said frame means drivingly connected to said traveling wheel of said leading outrigger; and support means connected to said frame means and extending away from said far-side force rollers and beyond said near-side traveling wheels; whereby downward pressure exerted via said support means is sustained by said traveling sheels on said first exposed structural roof member, and upward pressure exerted via said support means is sustained by said force rollers against said second exposed structural roof member.

12. The rolling support of claim 11 including a horizontal thrust wheel journaled in each of said outriggers and disposed adjacent one of said exposed structural roof members whereby to resist movement of said rolling support at right angles to said exposed structural roof members.

13. The rolling suppport of claim 11 in which at least one of said near-side traveling wheels has a flange adjacent said first exposed structural roof member, and a horizontal thrust wheel journaled in said frame means and positioned to bear against said first exposed structural roof member so as to keep said flange spaced from said first exposed structural roof member.

14. The rolling support of claim 11 including a far-side traveling wheel journaled in said leading outrigger and disposed above said second exposed structural roof member, and a nearside force roller journaled in said leading outrigger and adapted to engage beneath said first exposed structural roof member.

15. The rolling support of claim 14 including a horizontal thrust wheel journaled in one of said outriggers adjacent one of said exposed structural roof members whereby to resist movment of said rolling support at right angles to said structural roof members.

16. The rolling support of claim 11 including a far-side traveling wheel journaled in said trailing outrigger and disposed above said second exposed structural roof member, and a nearside force roller journaled in said trailing outrigger and adapted to engage beneath said first exposed structural roof member.

17. The rolling support of claim 16 including a horizontal thrust wheel journaled in one of said outriggers adjacent one of said exposed structural roof members whereby to resist movement of said rolling support at right angles to said exposed structural roof members.

* * * * *

UNITED STATES PATENT AND TRADEMARK OFFICE

CERTIFICATE OF CORRECTION

PATENT NO. : 4,074,789

DATED : February 21, 1978

INVENTOR(S) : DANIEL E. WARREN and DONALD M. TAYLOR

It is certified that error appears in the above-identified patent and that said Letters Patent are hereby corrected as shown below:

Column 1, line 36 cancel the word "the" second occurance.

Column 2, line 63 insert the word --not-- before the word "necessary".

Column 6, line 34 cancel the word "electricl" and insert --electrical--.

Column 7, line 48 cancel the italicized letter "l" appearing between 37a and the word "and"; also the setting forth of that word "and" in italics is questioned.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*